US008167634B2

(12) United States Patent
Fujiwara et al.

(10) Patent No.: US 8,167,634 B2
(45) Date of Patent: May 1, 2012

(54) CONNECTOR WITH A SEALING RING HAVING A BULGE AT ITS INNER PERIPHERAL SIDE OF ITS MAIN BODY

(75) Inventors: Michiyo Fujiwara, Yokkaichi (JP); Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/038,763

(22) Filed: Mar. 2, 2011

(65) Prior Publication Data

US 2011/0230086 A1 Sep. 22, 2011

(30) Foreign Application Priority Data

Mar. 17, 2010 (JP) ..... 2010-061208

(51) Int. Cl.
*H01R 13/52* (2006.01)

(52) U.S. Cl. ..... 439/271

(58) Field of Classification Search ..... 439/271–275, 439/587

See application file for complete search history.

(56) References Cited

U.S. PATENT DOCUMENTS 2,903,626 A 9/1959 Nye et al.
4,820,181 A * 4/1989 Kuzuno et al. ..... 439/272
5,217,337 A * 6/1993 Junemann et al. ..... 411/45
5,879,178 A * 3/1999 Koumatsu et al. ..... 439/271
5,927,725 A * 7/1999 Tabata et al. ..... 277/607
6,517,368 B2 * 2/2003 Hara et al. ..... 439/271
6,814,599 B2 * 11/2004 Sakiyama et al. ..... 439/271
6,953,357 B2 * 10/2005 Fukushima et al. ..... 439/271
7,011,539 B1 3/2006 Nagy et al.
2002/0031949 A1 3/2002 Miyazaki
2002/0155756 A1 10/2002 Yoshioka
2009/0124121 A1 5/2009 Matsuoka

* cited by examiner

*Primary Examiner* — Chandrika Prasad
(74) *Attorney, Agent, or Firm* — Gerald E. Hespos; Michael J. Porco

(57) ABSTRACT

A connector has a housing (40) including a terminal mounting portion (41), a receptacle (55) and a mounting flange (61) between the terminal mounting portion (41) and the receptacle (55). A seal ring (150) is mounted on a surface of the mounting flange (61) to be held in contact with a mounting wall (20) for sealing between the mounting flange (61) and the mounting wall (20). The seal ring (150) includes a ring main body (151) surrounding the outer periphery of the terminal mounting portion (41) and fixing portions (160) for fixing the ring main body (151) to the mounting flange (61). Each fixing portion (160) includes a bulge (161) at an inner peripheral side of the ring main body (151). A lock (165) projects from the bulge (161) toward a side opposite to a sealing surface and engages a locking hole (67) in the housing (40).

20 Claims, 19 Drawing Sheets

FRONT ⟷ BACK

CONNECTOR WITH A SEALING RING HAVING A BULGE AT ITS INNER PERIPHERAL SIDE OF ITS MAIN BODY

BACKGROUND OF THE INVENTION

1. Field of the Invention

The invention relates to a seal ring retaining structure used in a connector.

2. Description of the Related Art

U.S. Pat. No. 6,953,357 discloses a connector 2 with a housing 3, a flange 8 projecting out from the housing 3, terminal fittings 4 in the housing and a packing 1. The connector 2 is to be mounted on a case 5a of an electrical device 5. A mating housing 6 is connected to the housing 3 from the front so that an outer surface 6a of the mating housing 6 overlaps the flange 8 of the housing 3.

The packing 1 is mounted into a recessed groove 9 formed in the flange 8 and functions to make joint surfaces of both housings 3, 6 watertight. Locking claws 17 on the packing 1 engage with locking holes 10 in the flange 8 to fix the packing 1 to the housing 3. The locking claws 17 are formed at an outer peripheral side of the packing 1. Thus, the locking holes 10 that engage the locking claws 17 also are formed at an outer side of the packing 1 and penetrate through the flange 8. Thus, water easily enters and a waterproof property is hardly good. Further, a space is necessary for the locking claws 17 and the locking holes 10 at the outer side of the packing 1 and therefore the connector becomes larger.

The invention was developed in view of the above situation and an object of the invention is to improve a sealing property and miniaturize a connector.

SUMMARY OF THE INVENTION

The invention relates to a connector with a housing that has a terminal mounting portion to be fit into a shaft hole formed in a wall of a mounting member. The connector also has a receptacle for receiving a mating connector and a flange between the terminal mounting portion and the receptacle. The flange is to be mounted on the wall of the mounting member. At least one terminal is mounted into the terminal mounting portion so that a portion of the terminal projects into the receptacle. A seal ring is mounted on the flange substantially facing the mounting member for sealing between the flange and the wall surface of the mounting member. The seal ring includes an annular main body surrounding the outer periphery of the terminal mounting portion and at least one fixing portion for fixing the main body to the flange. The fixing portion includes at least one bulge at or near an inner peripheral side of the ring main body. At least one lock projects from the bulge toward a side opposite a sealing surface and toward the mounting member. The lock is engageable with at least one locking hole formed in the housing.

Disposition of the lock at the inner peripheral side of the ring main body avoids the needs to form a locking hole in an outer wall of the housing. Therefore, water is less likely to enter than with a conventional structure and a waterproof or sealing property is improved. Further, the connector can be miniaturized easily.

The flange may be formed with a fastening seat including at least one bolt insertion hole for receiving a bolt. The fixing portion may be formed at a position on the inner periphery of the ring main body substantially corresponding to a formation position of the fastening seat.

The connector is pressed strongly and the seal ring easily adheres to the wall surface of the mounting member at a position near the bolt. A seal ring that adheres to the mounting member may detach from the connector when the connector is detached by loosening the bolt. However, the fixing portion of the invention is at the bolt tightening position. Thus, the seal ring will not adhere to the mounting member and will not detach from the connector.

The shaft hole in the wall of the mounting member may be substantially rectangular. The fastening seat may be formed at the four corners of the mounting flange and the mounting flange may be bolted at the four corners of the shaft hole.

The terminal mounting portion may have a rectangular shape to fit into the shaft hole. The ring main body may have a substantially rectangular shape slightly larger than the outer shape of the terminal mounting portion, and the fixing portion may be formed at each of corners of the ring main body. Accordingly, the seal ring will not adhere to the mounting member and the seal ring is not likely to detach from the connector when the connector is detached from the mounting member by loosening the bolts.

Each bulge may have a fan shape widened toward the corresponding corner of the ring main body, thereby increasing the rigidity of each fixing portion.

The connector may further comprise at least one pressing wall formed in the housing for pressing the rear surface of the lock engaged with the locking hole. The pressing wall may have at least one tapered surface for guiding an engaging operation when the lock is engaged with the locking hole. Accordingly, the engaging operation can be performed smoothly and with good mounting efficiency.

At least one guiding slant may be formed at a leading end of the lock.

At least one annular lip may be formed at front and/or rear sides of the ring main body.

At least one plate may project in from the ring main body and may be dimensioned to fit closely into at least one flat portion formed in the housing. The plate may be engaged with hooks of the housing and may be formed with one or more hook holes to engage with the respective hooks.

The seal ring may be mounted into an annular mounting groove in the flange.

A base may be formed on the flange and may be located at an inner side of the mounting groove may. The base may comprise one or more high walls and/or one or more low walls.

The connector may further comprise a shield shell made of at least one conductive plate. The shield shell includes a shell main body and resilient contact pieces mountable on the housing to shield the connector. Shield pieces may be formed on the shell main body and may project into the receptacle through communication holes in the flange and for at least partly surrounding a portion of the terminal.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
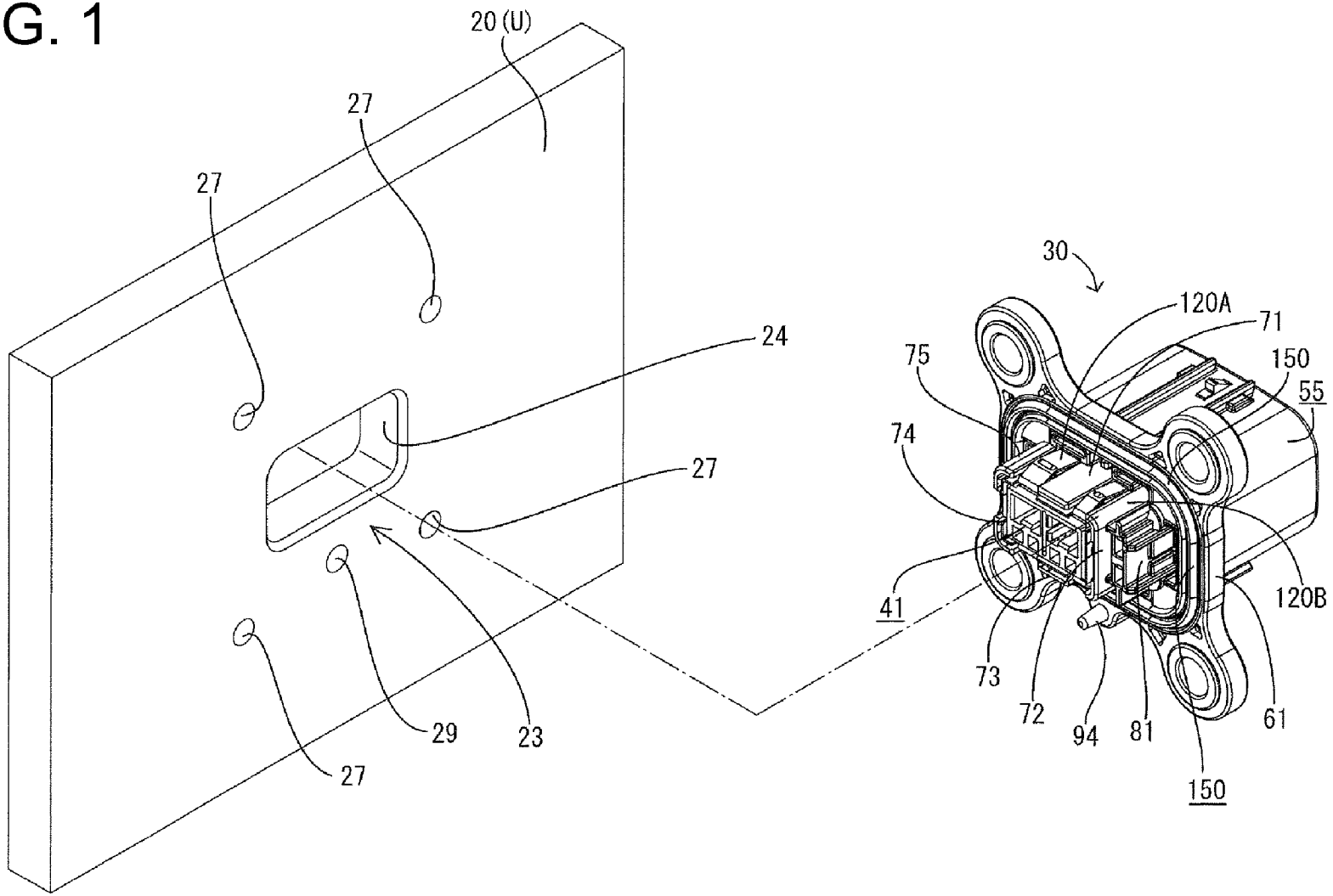
FIG. 1 is a perspective view showing a shield connector mounting structure according to one embodiment of the invention.
Figure 2:
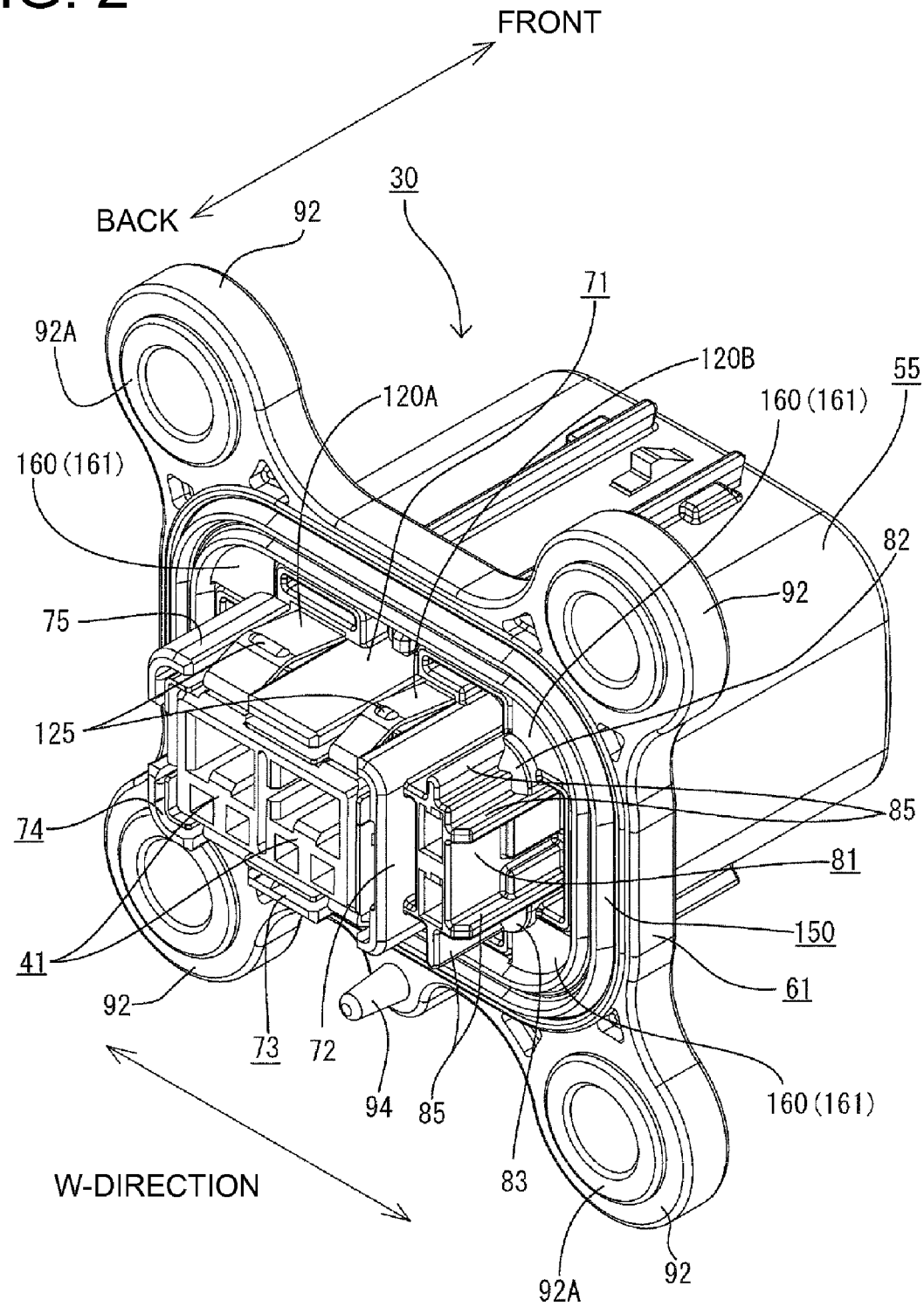
FIG. 2 is a perspective view of the shield connector.

A shield connector in accordance with the invention is identified by the numeral 30 in FIGS. 1 and 2. The shield connector 30 is to be mounted directly on a case U of an electrical device e.g. installed in an electric vehicle. The case U is made of, e.g. aluminum alloy and is box-shaped. An outer peripheral wall of the case U defines a mounting wall 20 on which the shield connector 30 is to be mounted.

As shown in FIG. 1, a rectangular shaft hole 23 penetrates the mounting wall 20 of the case U. The shaft hole 23 is somewhat longer in a lateral direction and has four rounded corners. Bolt holes 27 are formed at four positions corresponding to the four corners of the shaft hole 23 and a positioning hole 29 is formed below the shaft hole 23.

Figure 3:
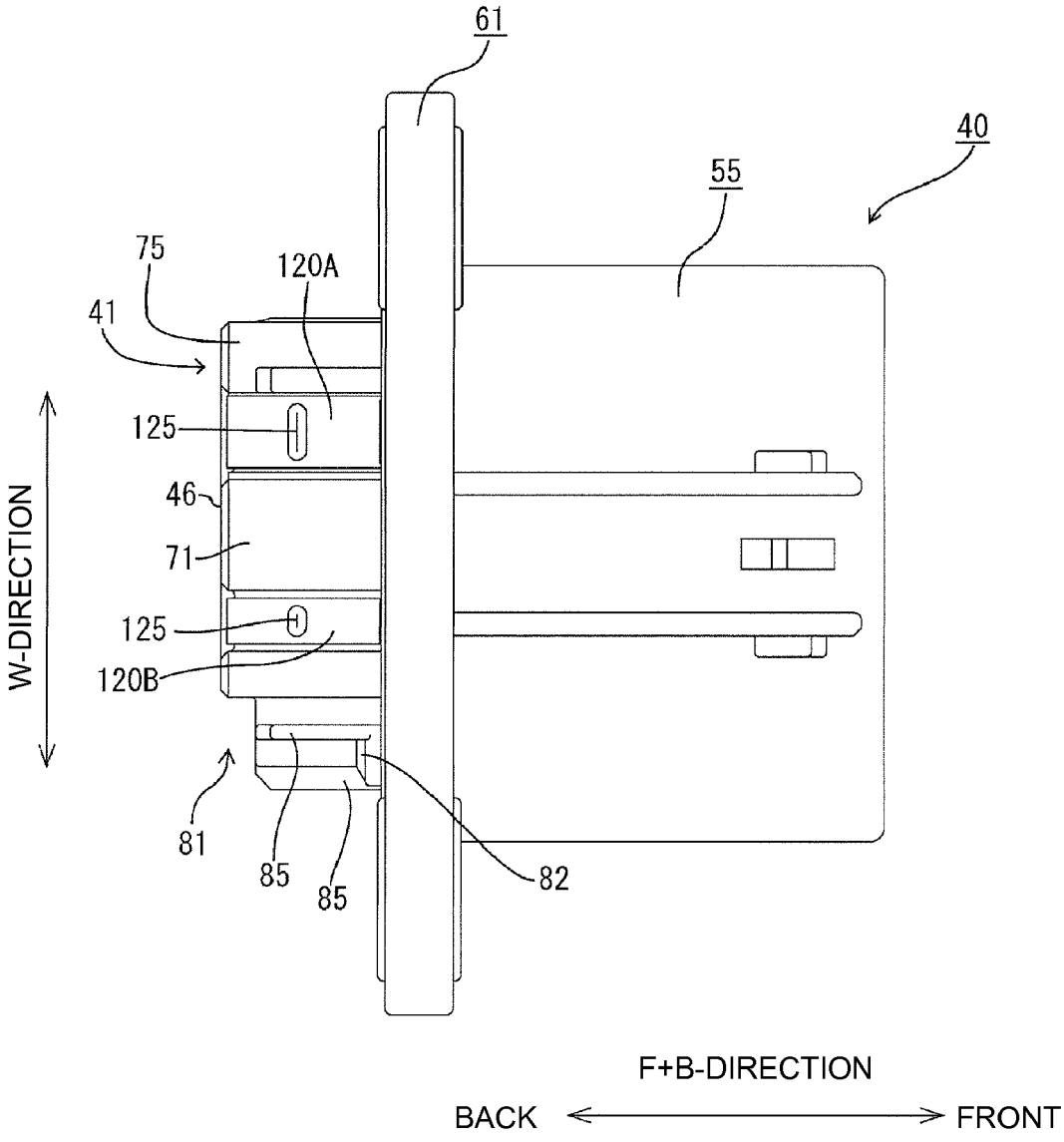
FIG. 3 is a plan view of the shield connector.

The shield connector 30 includes a housing 40 made e.g. of synthetic resin. The housing 40 has a terminal mounting portion 41 that is fit into the shaft hole 23 as shown in FIG. 1. In the following description, forward and backward directions indicate a fitting direction into the shaft hole 23 and right and left sides of FIG. 3 are defined respectively as the front and rear.

The housing 40 is made unitarily e.g. of synthetic resin and includes the terminal mounting portion 41, a receptacle 55, a flange 61 and protection walls 70 as shown in FIGS. 2 to 6.

The terminal mounting portion 41 is substantially a wide block with two cavities 42 formed substantially side by side in the width direction. The cavities 42 are open in a rear end surface 46 of the terminal mounting portion 41 to receive male terminals 31 inserted from behind.

Each male terminal 31 is formed by bending a conductive metal plate punched or cut into a specified shape. A tab 32 is provided at a leading end of the male terminal 31 and is electrically conductively connectable to a mating female terminal fitting (not shown). The male terminal 31 is to be fixed to a core exposed at an end of a wire 35 by being soldered, crimped, bent, folded or deformed.

The front ends of the cavities 42 communicate with the receptacle 55 and the tabs 32 of the male terminals 31 project from the terminal mounting portion 41 into the receptacle 55.

A locking lance 43 is formed at the bottom wall of each cavity 42 for holding the male terminal 31 in a retained state. The locking lance 43 is resiliently displaceable up and down in direction intersecting an insertion direction of the male terminal 31 into the cavity 42. A lance deformation space for the locking lance 43 is provided below and adjacent to the locking lance 43.

An auxiliary terminal mounting portion 81 is formed laterally of the terminal mounting portion 41, e.g. to the right in FIG. 2. The auxiliary terminal mounting portion 81 has auxiliary cavities 81A in upper and lower levels for accommodating respective auxiliary terminals (not shown) for interlock detection. Contact pieces 85 are formed on an outer wall of the auxiliary terminal mounting portion 81 and extend toward the back of the housing 40. One contact piece 85 is formed at each of the upper and lower walls of the auxiliary terminal mounting portion 81 and two contact pieces 85 are formed on the right wall of the auxiliary terminal mounting portion 81.

Figure 18:
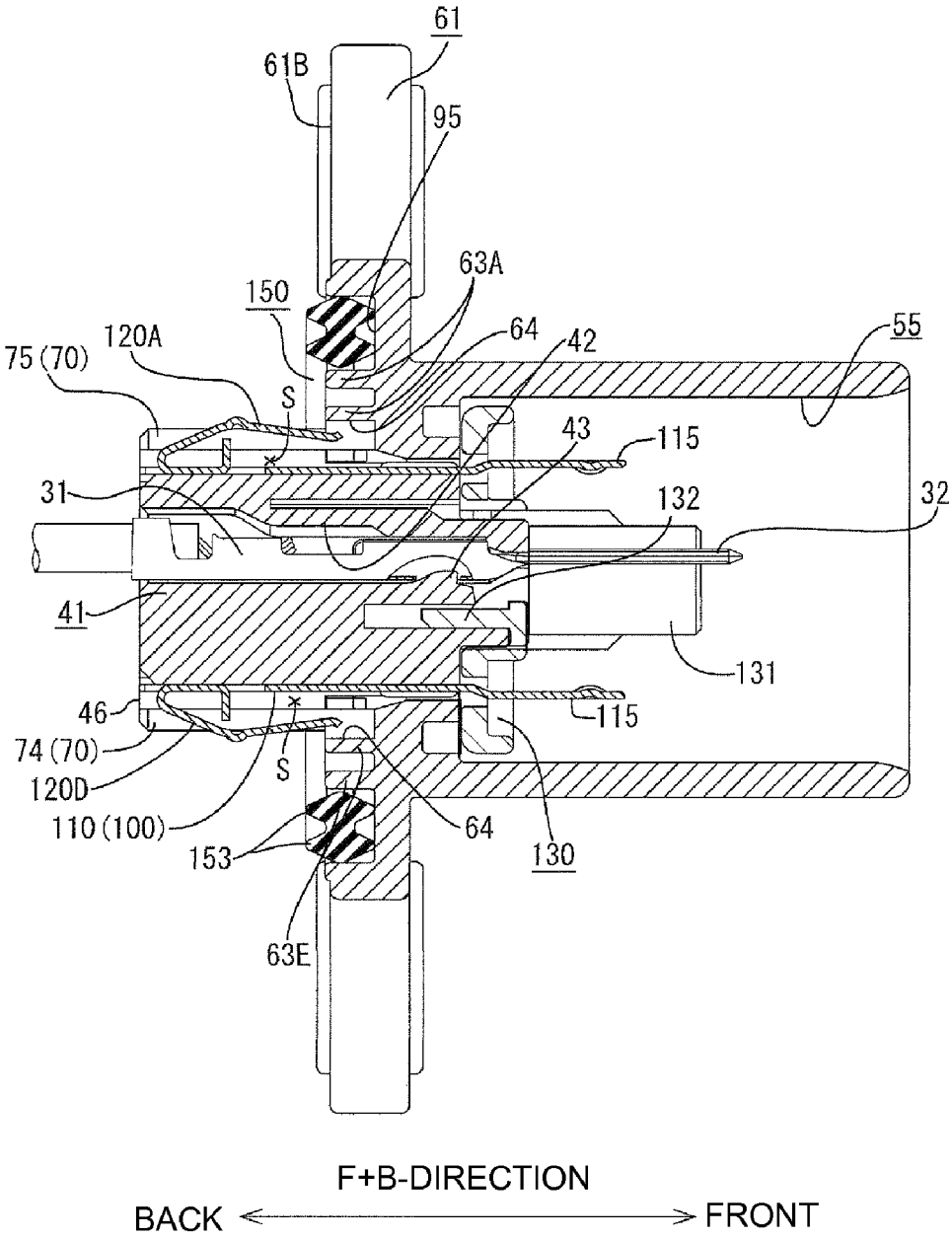
FIG. 18 is a section along E-E of FIG. 4 of the shield connector.

The receptacle 55 is a tube with an open front end to receive a mating connector (not shown) inserted from the front. A retainer 130 also is to be inserted into the receptacle 55 from the front, as shown in FIG. 18. The retainer 130 includes restricting pieces 132 that are insertable into the lance deformation spaces when the retainer 130 is mounted into the receptacle 55 to restrict deformations of the locking lances 43 in unlocking directions. Further, the retainer 130 has a partition wall 131 that separates the two tabs 32 projecting into the receptacle 55.

Figure 4:
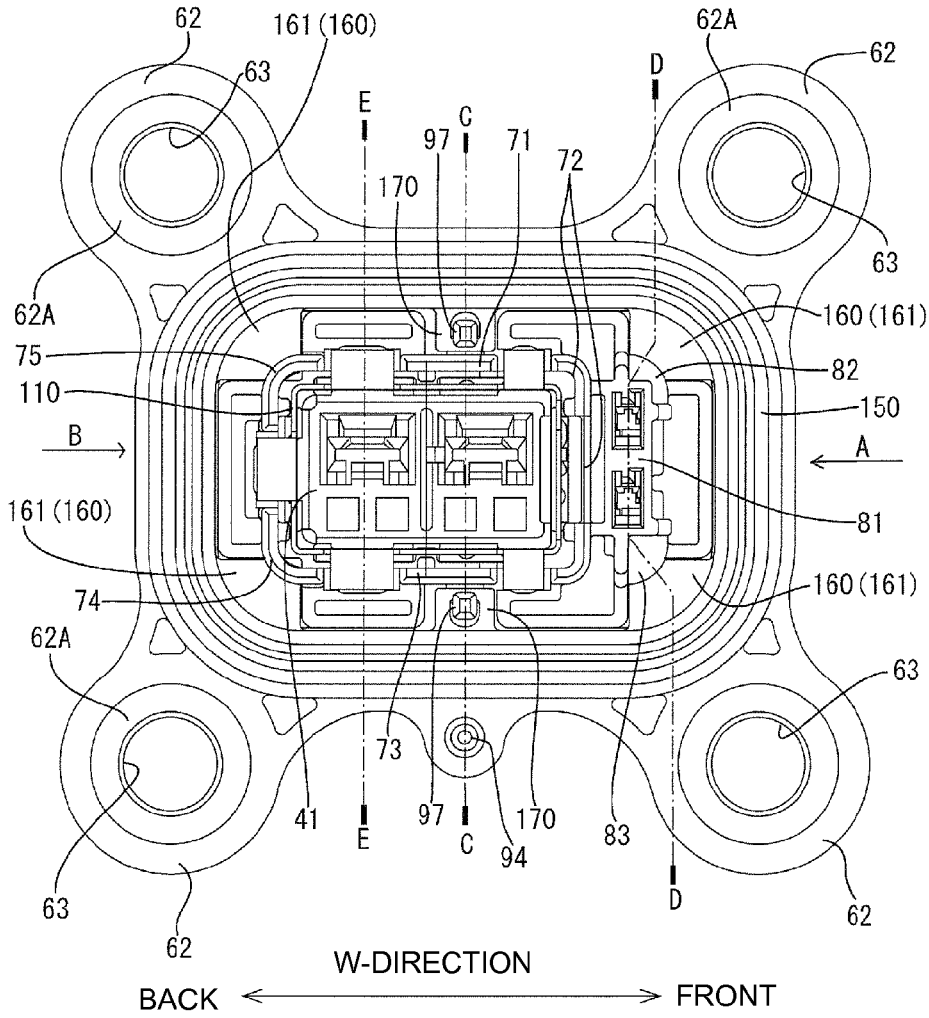
FIG. 4 is a rear view of the shield connector.
Figure 5:
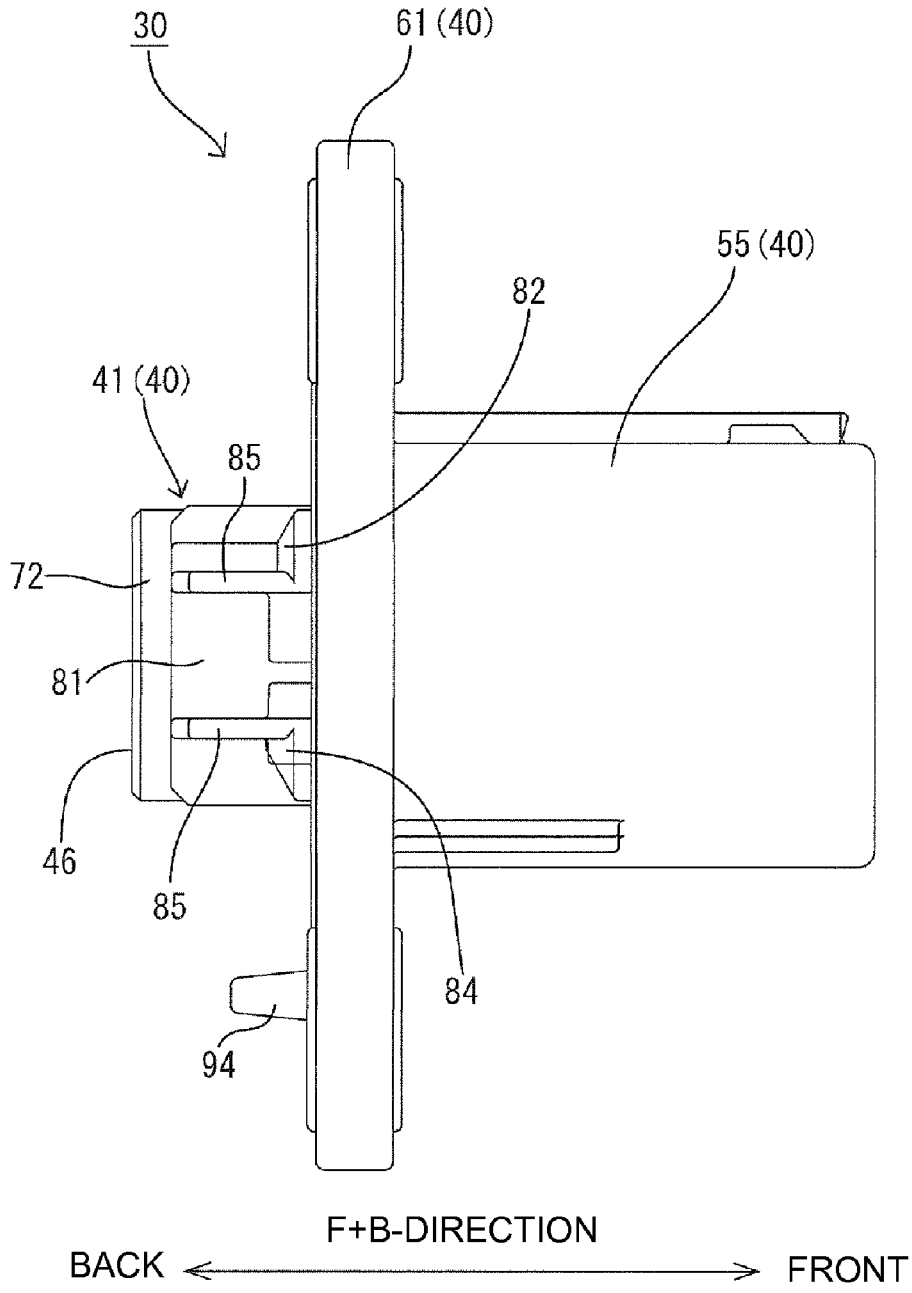
FIG. 5 is a side view of a shield shell when the shield connector of FIG. 4 is viewed in a direction A.
Figure 6:
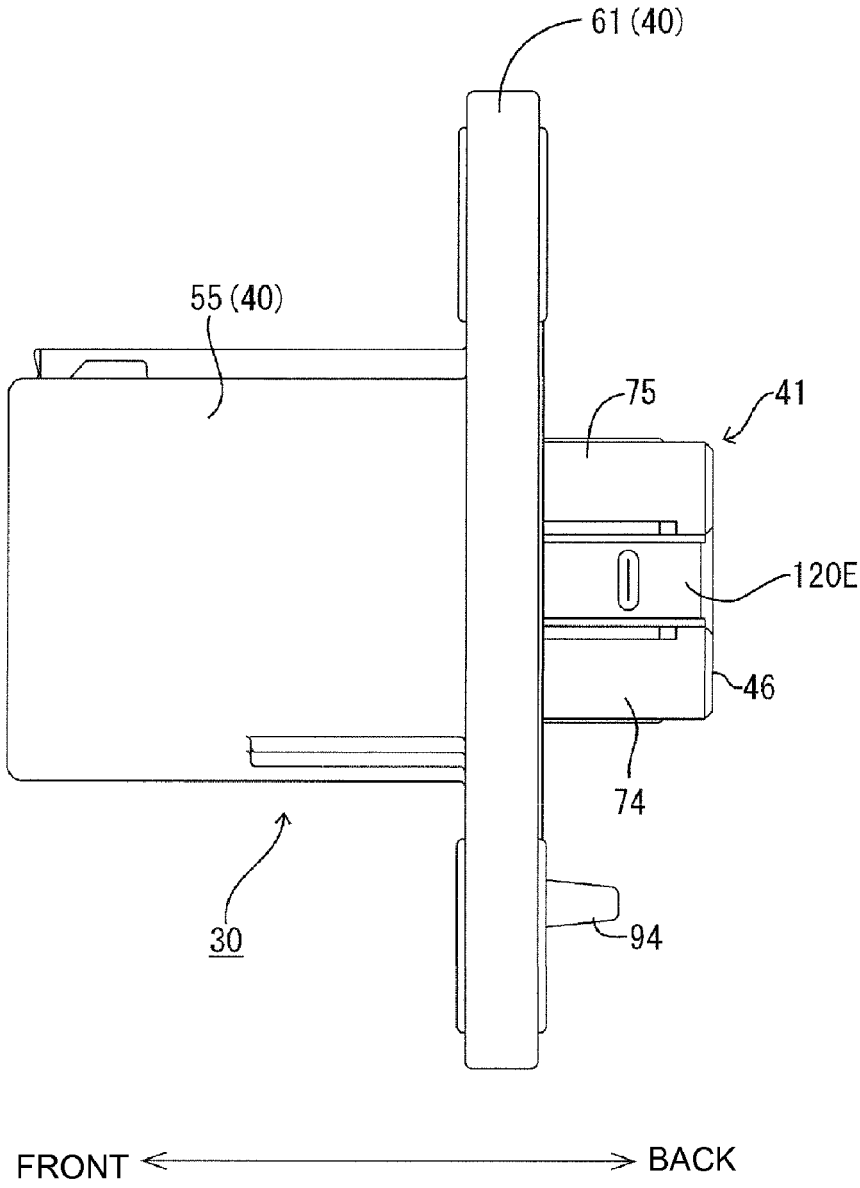
FIG. 6 is a side view of the shield shell when the shield connector of FIG. 4 is viewed in a direction B.
Figure 7:
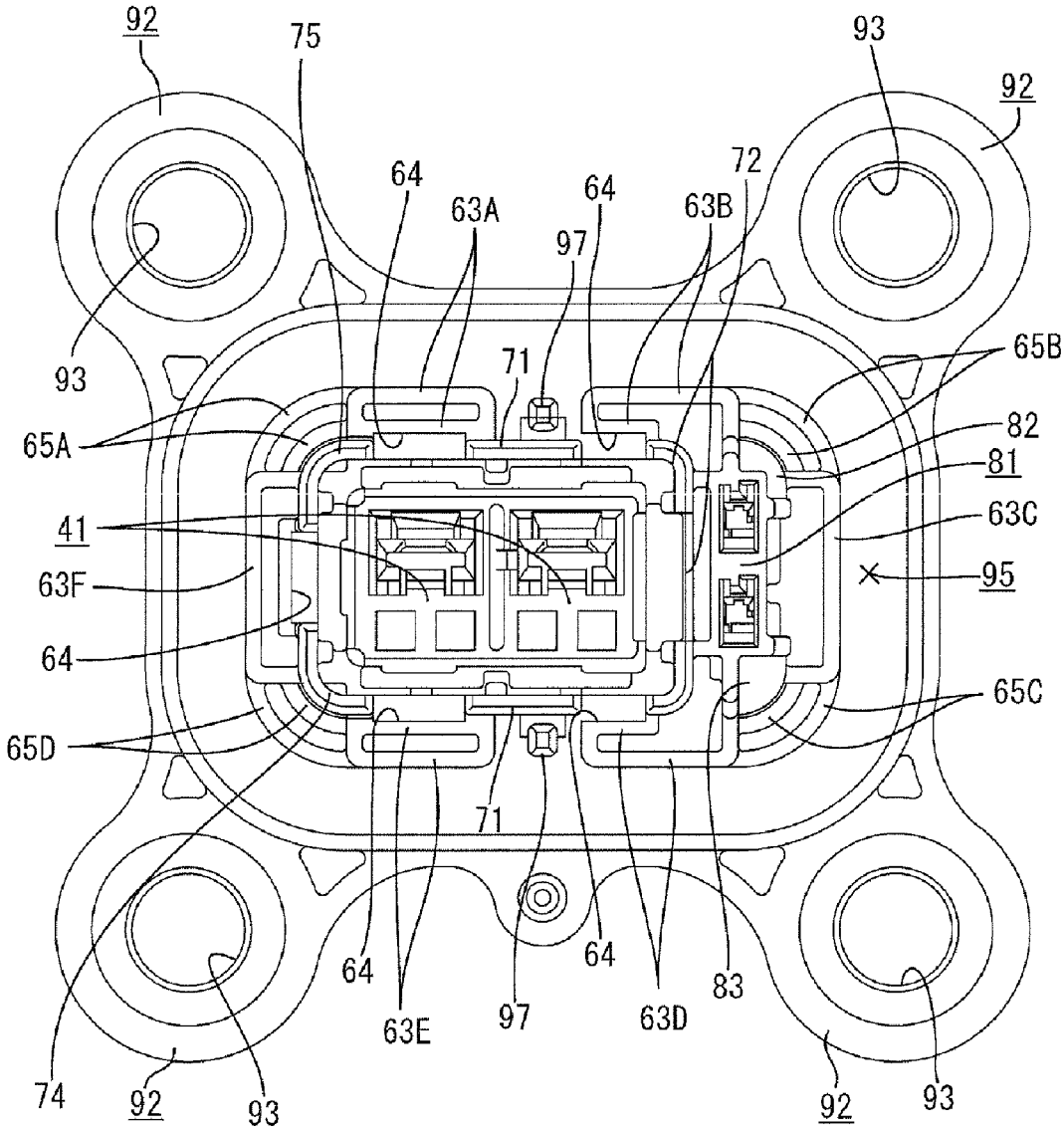
FIG. 7 is a rear view of a housing.

The flange 61 projects out between the terminal mounting portion 41 and the receptacle 55. The flange 61 is wide in the lateral direction as shown in FIG. 4 when viewed from behind and is larger than the shaft hole 23 of the mounting wall 20.

Substantially circular fastening seats 92 are formed at four corners of the flange 61 and each has a conductive metal collar 92A inserted therein. The fastening seats 92 have bolt insertion holes 93 that correspond to the four bolt holes 27 in the mounting wall 20. The flange 61 is formed with a positioning boss 94 corresponding to the positioning hole 29 in the mounting wall 20. Because of the above construction, when the boss 94 is fit into the positioning hole 29, the shield connector 30 is positioned on the mounting wall 20 and the four bolt insertion holes 93 of the shield connector 30 align respectively with the respective four bolt holes 27 of the mounting wall 20.

The flange 61 has a rear surface 61B with an annular mounting groove 95 for receiving the seal ring 150 and a base 62 is at an inner side of the mounting groove 95. The base 62 has high walls 63 and low walls 65, as shown in FIGS. 8 and 9.

The high walls 63 are formed at six positions distributed around the terminal mounting portion 41 and the auxiliary terminal mounting portion 81. Specifically, as shown in FIG. 8, two high walls 63A, 63B are formed substantially side by side above the terminal mounting portion 41. Further, two high walls 63D, 63E are formed substantially side by side below the terminal mounting portion 41. A high wall 63C is formed at a right outer side of the auxiliary terminal mounting portion 81 and a high wall 63F is formed at a left outer side of the terminal mounting portion 41.

Each of the high walls 63A, 63B, 64D, 63E and 64F is formed with an accommodating recess 64. Each accommodating recess 64 has an open rear end, and receives the leading end of a corresponding resilient contact piece 120 of the shield shell 100 to be described later.

Figure 8:
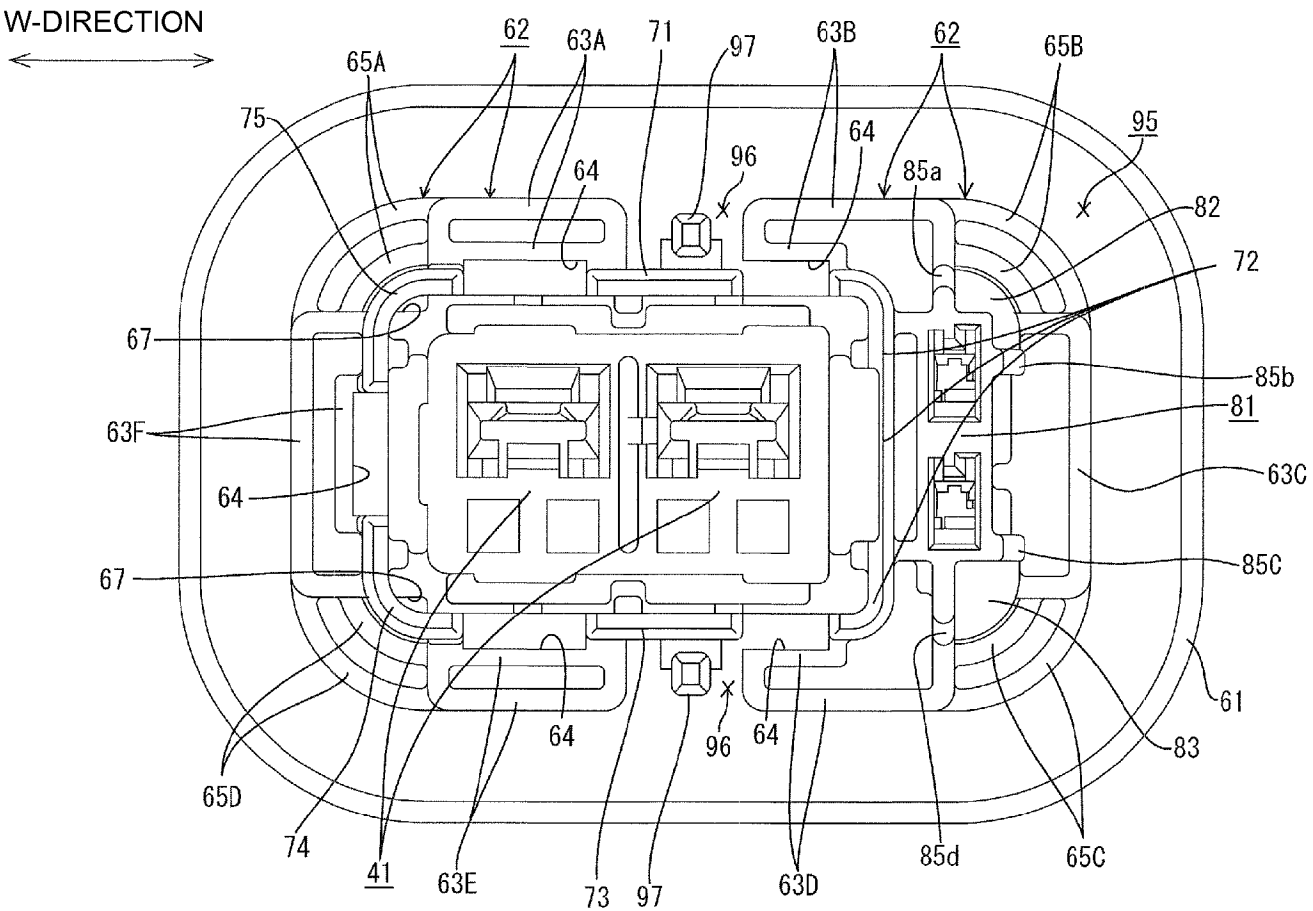
FIG. 8 is an enlarged view showing a part of FIG. 7.
Figure 9:
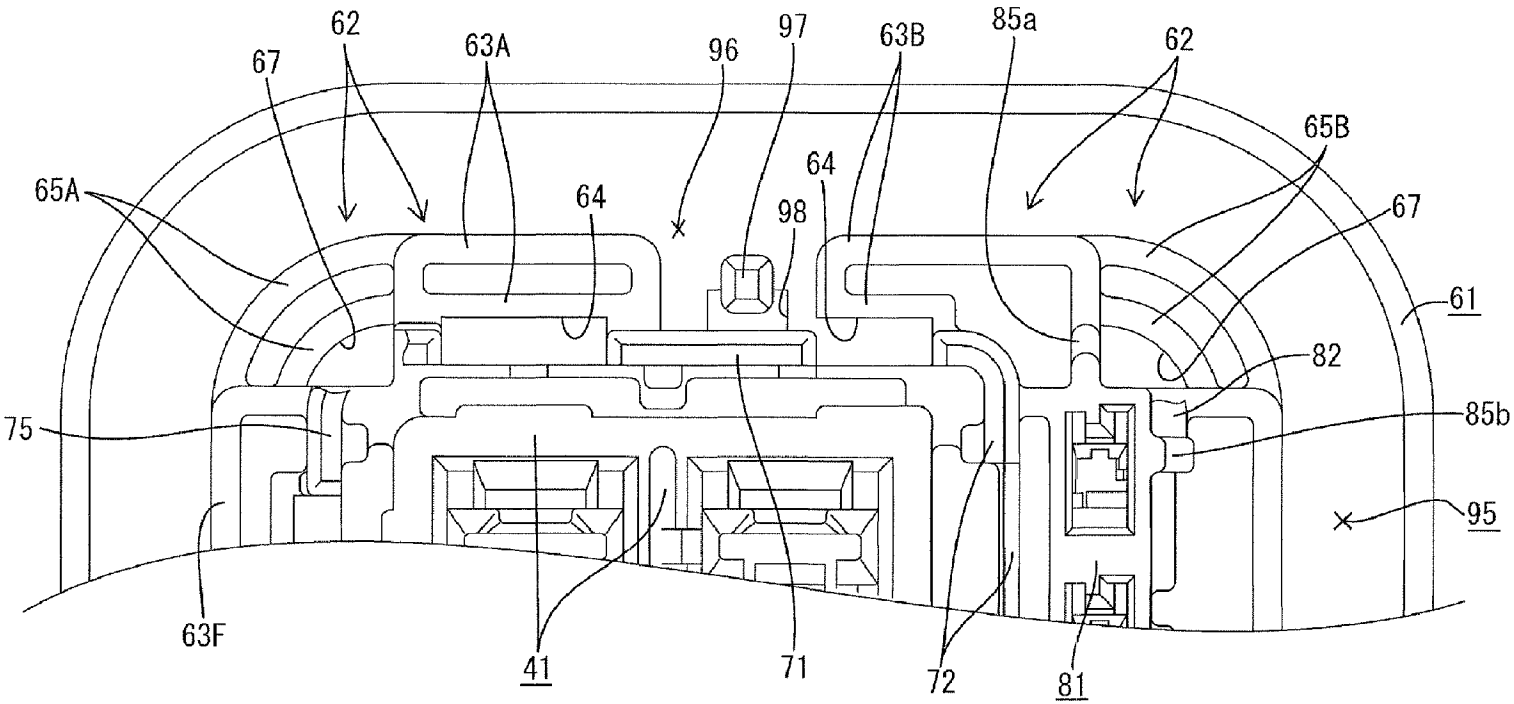
FIG. 9 is an enlarged view showing a part of FIG. 8 (without a pressing wall and a protection wall).
Figure 10:
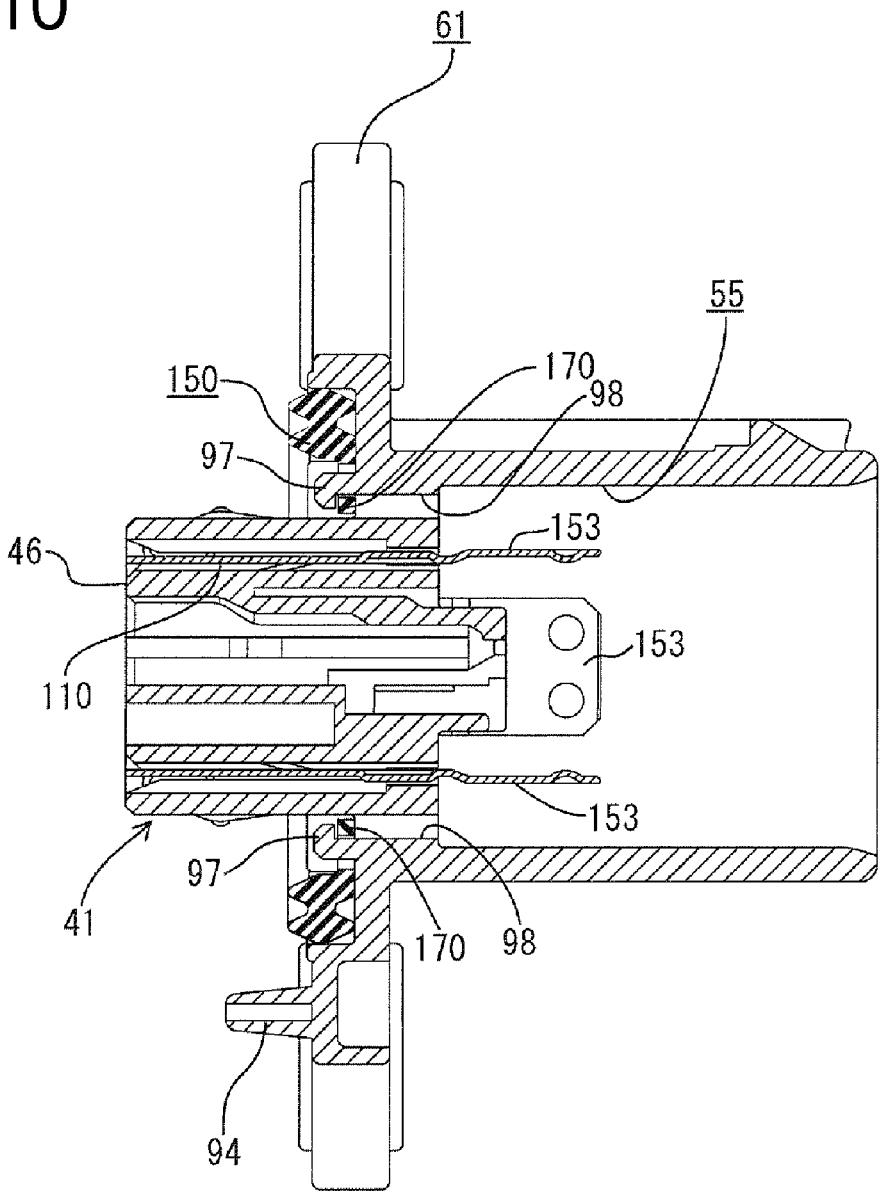
FIG. 10 is a section along C-C of FIG. 4 of the shield connector.

Flat surfaces 96 extend from the mounting groove 95 and are formed between the two high walls 63A, 63B and between the two high walls 63D, 63E as shown in FIG. 8. The flat surfaces 96 are located substantially in the widthwise center of the housing 40. Key-shaped hooks 97 project from the flat surfaces 96 and drain holes 98 substantially surround the hooks 97. The hooks 97 engage the seal ring 150 (see FIG. 10).

Referring back to FIG. 8, the low walls 65A to 65D are formed adjacent to the six high walls 63A to 63F and are slightly lower than the high walls 63A to 63F. The low walls 65 define fan shapes located at corners of the terminal mounting portions 41, 81, and locking holes 67 are formed in central parts at the centers of the fan-shapes, as shown in FIG. 9.

Figure 11:
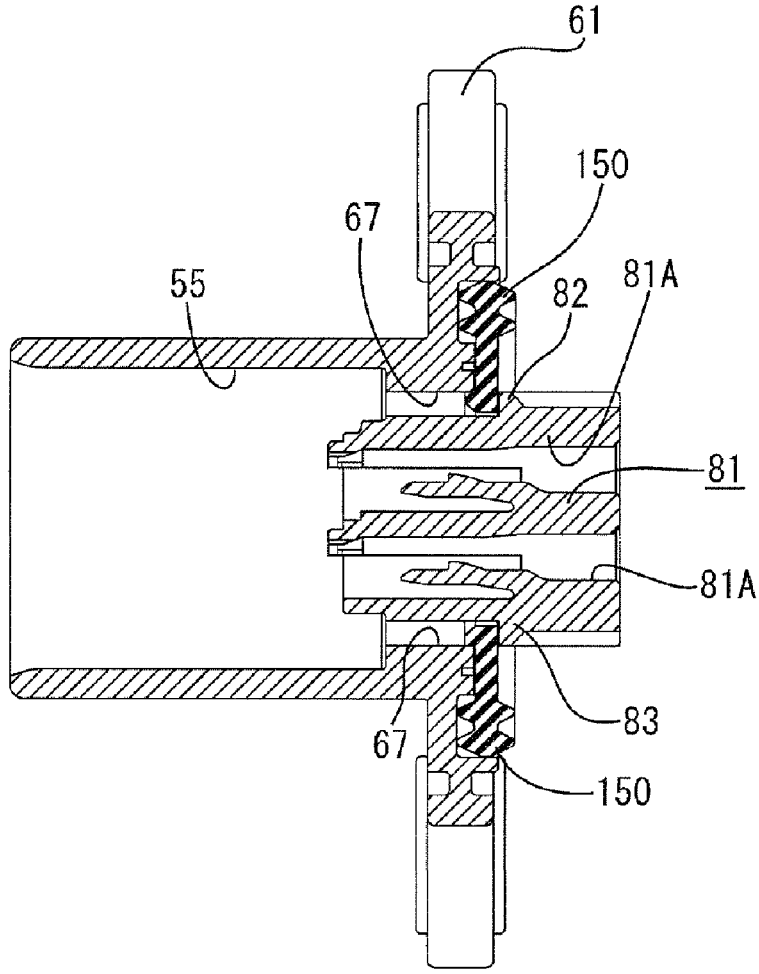
FIG. 11 is a section along D-D of FIG. 4 of the shield connector.

The locking holes 67 extend toward the front side of the housing 40 (leftward in FIG. 11) and communicate with the receptacle 55, as shown in FIG. 11. The locking holes 67 are engaged with respective locks 165 formed on the seal ring 150.

Pressing walls 82, 83 are formed respectively in the locking holes 67 of the low walls 65B, 65C. The pressing walls 82, 83 function to hold the seal ring 150 in a locked state as explained further below.

Figure 13:
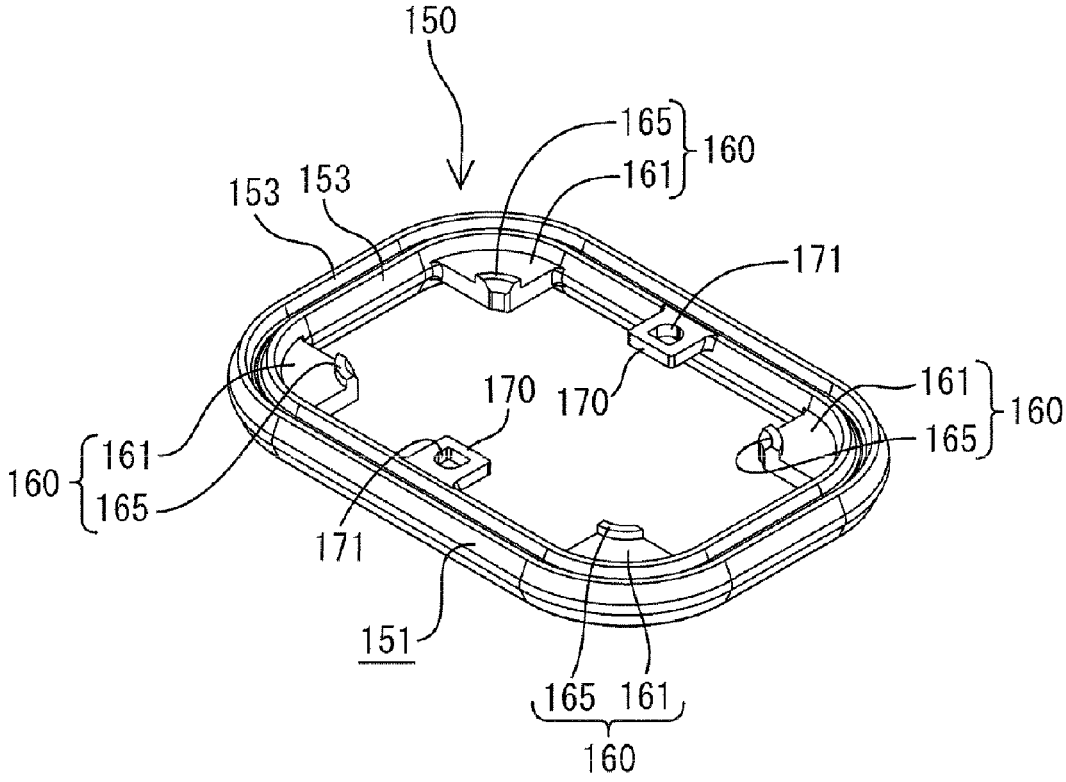
FIG. 13 is a perspective view of a seal ring.
Figure 14:
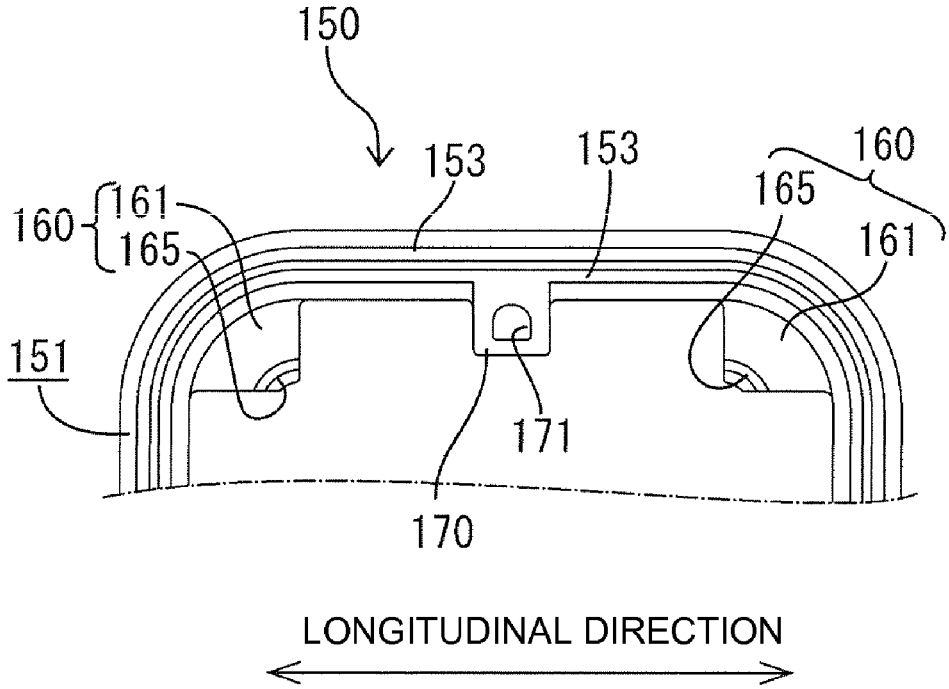
FIG. 14 is a plan view of the seal ring.

The seal ring 150 is made of resilient material, such as rubber, and includes a ring main body 151, fixing portions 160 for fixing the ring main body 151 and two plates 170, as shown in FIGS. 13 and 14. The ring main body 151 defines a closed loop with a substantially rectangular outer shape slightly larger than the outer shape of the base 62, and is to be mounted into the mounting groove 95 of the mounting flange 61. Annular lips 153 are formed on each of the front and rear sides of the ring main body 151. Because of the above construction, the ring main body 151 is held resiliently in contact with a wall surface of the mounting wall 20 around the shaft hole to seal around the shaft hole when the shield connector 30 is mounted on the mounting wall 20.

Plates 170 project unitarily in from central parts of longer sides of the ring main body 151 and are dimensioned to fit closely into the flat portions 96 in the housing 40. Additionally, the plates 170 are formed with hook holes 171 to engage the respective hooks 97 for fixing the center of the ring main body 151 to the housing 40.

The fixing portions 160 are formed unitarily at four corners of the ring main body 151. As shown in FIGS. 13 and 14, each fixing portion 160 includes a bulge 161 and a lock 165.

The bulges 161 are formed at an inner peripheral side of the ring main body 151. Each bulge 161 has a substantially fan shape widened toward the corresponding corner of the ring main body 151. The bulges 161 have substantially the same shapes as the corresponding low walls 65 and have thicknesses equal to a height difference between the low walls 65 and the high walls 63. Thus, when the seal ring 150 is assembled, the four bulges 161 are placed closely on the corresponding low walls 65A to 65D and the upper surfaces thereof are substantially flush with upper surfaces of the adjacent high walls 63A to 63F.

The locks 165 are provided at the leading ends of the bulges 161 and project toward a side (upper side in FIG. 13) substantially opposite to a sealing surface toward the mounting flange 61. Guiding slants 165A are formed at the leading ends of the locks 165.

Figure 12:
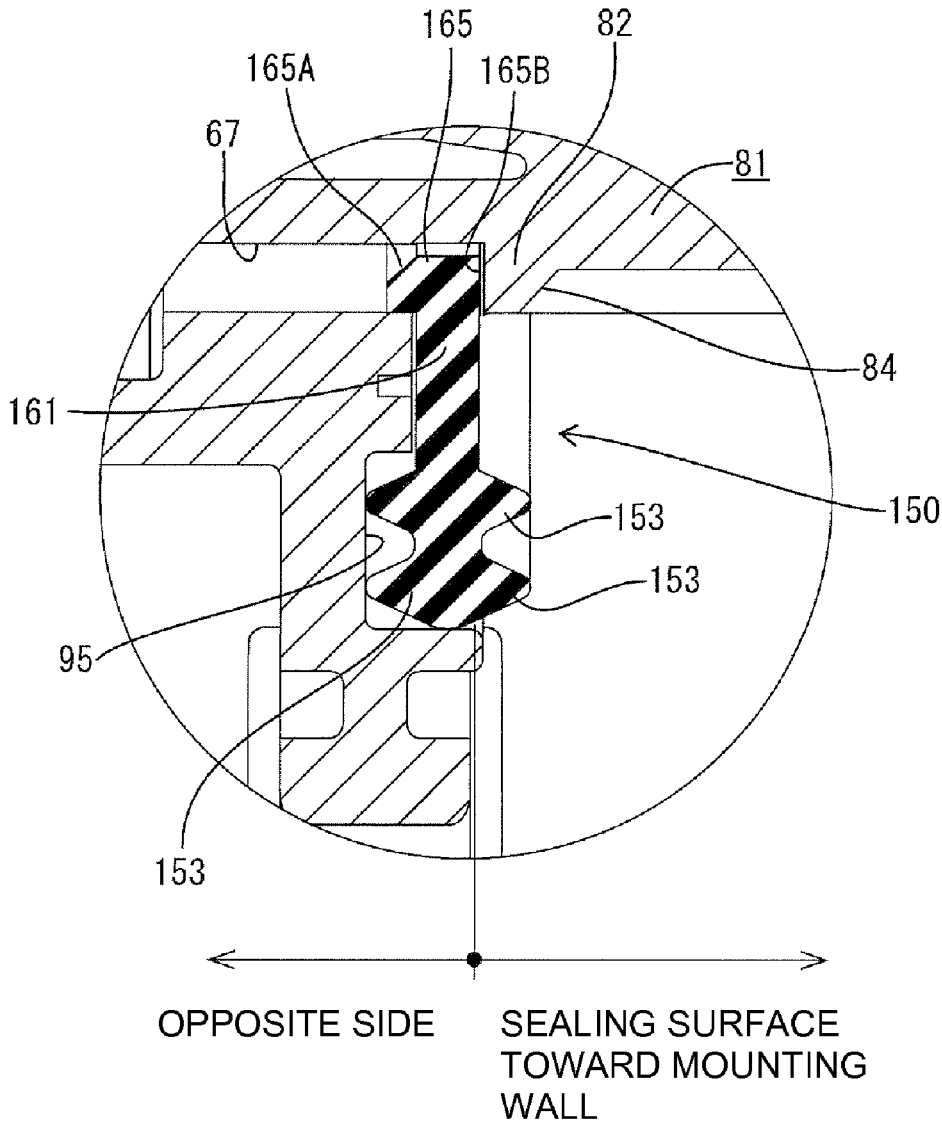
FIG. 12 is a diagram showing a locking structure of a locking portion (enlarged view of FIG. 11).

The above-described construction enables the locks 165 to engage the corresponding locking holes 67 for fixing the ring main body 151 to the housing 40. In the locked state, the pressing walls 82, 83 and the base ends of the protection walls 74, 75 press the rear surfaces 165B of the locks 165 that are engaged with the locking holes 67, as shown in FIG. 12. Thus, the locked state is maintained, even if an external force acts in an unlocking direction.

The pressing wall 82 is formed between the two contact pieces 85*a* and 85*b* on the outer peripheral wall of the auxiliary terminal mounting portion 81 and has a substantially arcuate shape, as shown in FIGS. 2 and 8. The pressing wall 82 overlaps the locking hole 67 of the low wall 65B when the housing 40 is viewed from behind, and at least partly closes the rear side of the locking hole 67.

The pressing wall 83 is formed between the two contact pieces 85*c* and 85*d* on the outer peripheral wall of the auxiliary terminal mounting portion 81 and has an arcuate shape as shown in FIGS. 2 and 8. This pressing wall 83 overlaps the locking hole 67 of the low wall 65C when the housing 40 is viewed from behind (left side of FIG. 3), and at least partly closes the rear side of the locking hole 67.

By employing such a construction, the respective pressing walls 82, 83 press the rear surfaces 165B of the locking portions 165 to maintain the locked state, as shown in FIGS. 11 and 12, when the locking portions 165 of the seal ring 150 are engaged with the locking holes 67 of the low walls 65B, 65C. Tapered surfaces 84 are defined on the outer peripheral surfaces of the pressing walls 82, 83 so that the locking portions 165 can be smoothly engaged with the locking holes 67.

Five protection walls 71 to 75 are formed substantially adjacent to and at least partly surrounding the terminal mounting portion 41, as shown in FIG. 8. The protection walls 71 to 75 extend substantially horizontally back from the high walls 63A to 63F of the base 62, and the rear ends thereof reach the rear end surface 46 of the terminal mounting portion 41. The protection walls 71 to 75 substantially surround sides of the resilient contact pieces 120 while avoiding mount positions of the resilient contact pieces 120 to be described later.

The protection walls 75, 74 at upper and lower left sides in FIG. 8 press the rear surfaces 165B of the locks 165 of the seal ring 150 engaged with the locking holes 67 to maintain the locked state, similar to the pressing walls 82, 83 described above.

The protection wall 75 overlaps the locking hole 67 of the low wall 65A when the housing 40 is viewed from behind (from the left side of FIG. 3) and at least partly closes the rear of the locking hole 67. Similarly, the protection wall 74 at least partly closes the rear side of the locking hole 67 of the low wall 65D. Because of the above construction, base ends of the respective protection walls 74, 75 press the rear surfaces 165B of the locking portions 165 when the locking portions 165 of the seal ring 150 are engaged with the locking holes 67 of the low walls 65A, 65D to maintain the locked state. Note that the pressing wall 82 and the protection wall 75 are not shown in FIG. 9 to show the locking holes 67.

Figure 15:
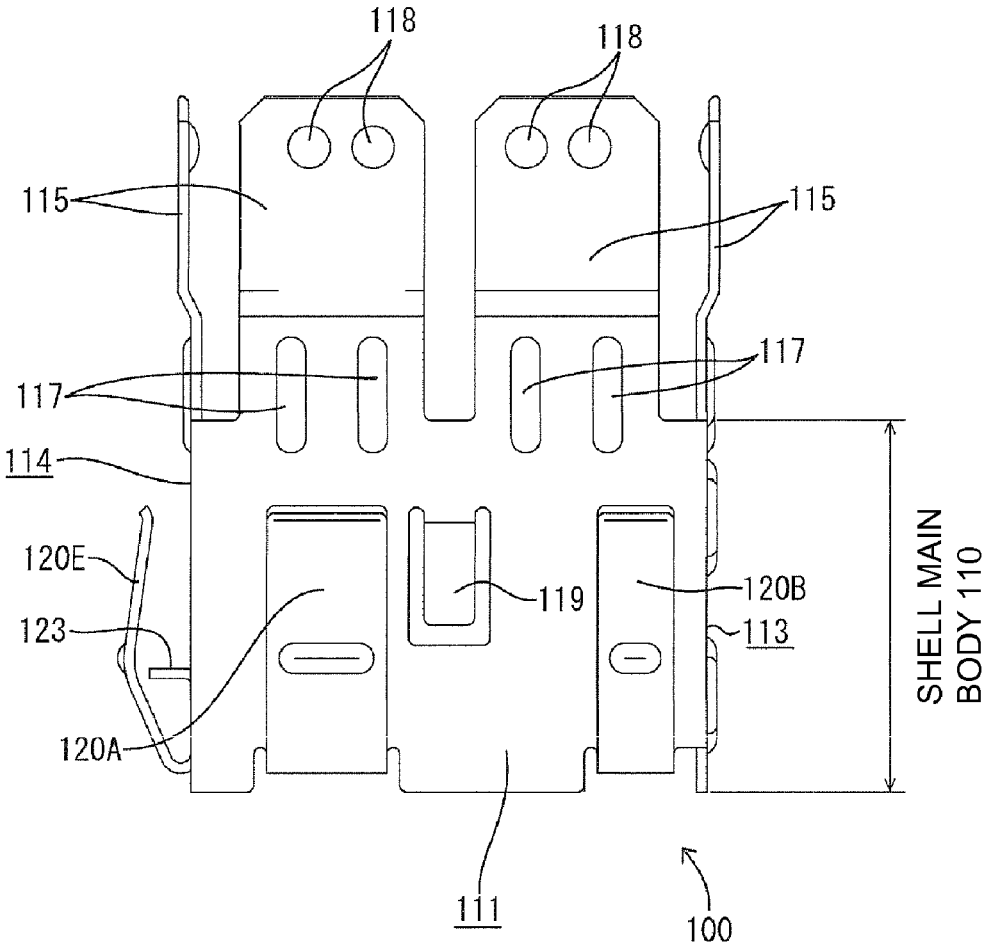
FIG. 15 is a plan view of the shield shell.
Figure 16:
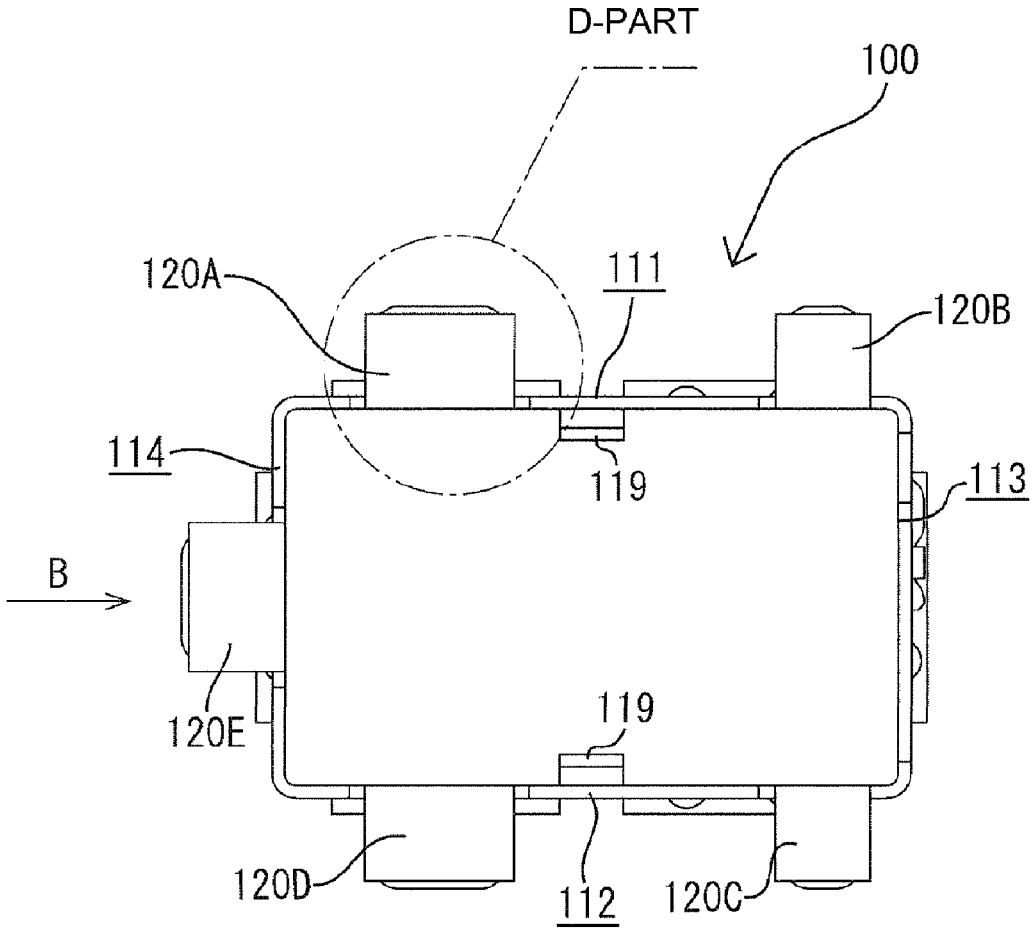
FIG. 16 is a rear view of the shield shell.
Figure 17:
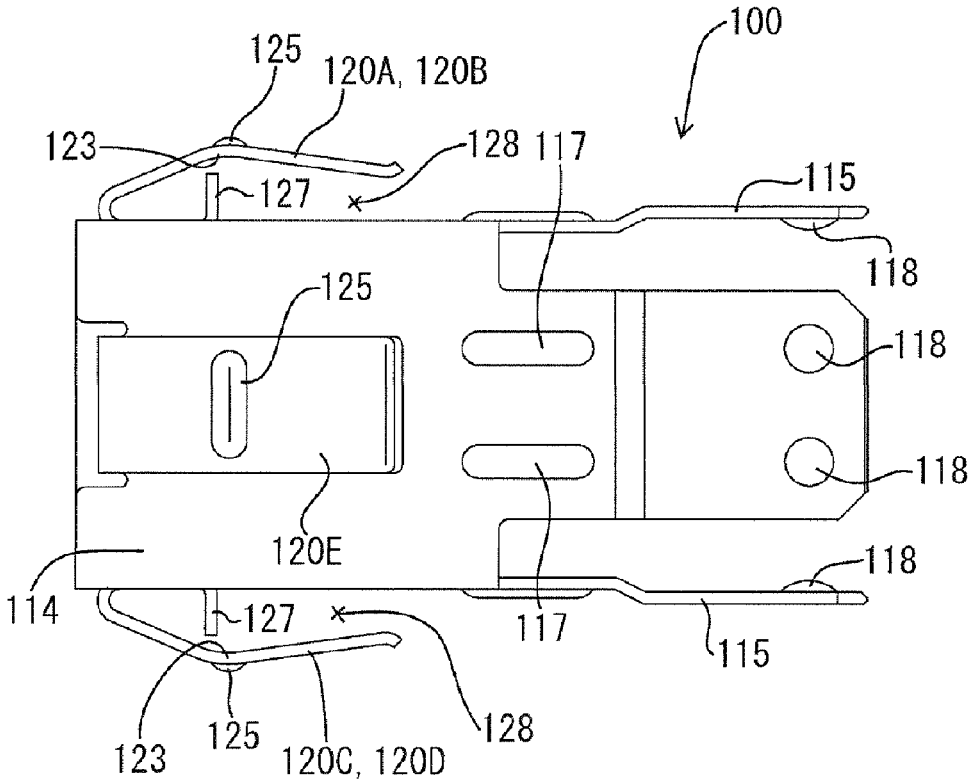
FIG. 17 is a side view of the shield shell.

The shield shell 100 is made of at least one conductive metal plate and includes a shell main body 110 and resilient contact pieces 120 (see FIGS. 15 to 17). The shell main body 110 is a substantially rectangular tube and shield pieces 115 are provided at its front end. The shield pieces 115 are plate-like and extend horizontally forward. Two beads 117 are formed substantially side by side at a base end portion of each shield piece 115 and protuberances 118 are formed near a leading end portion of each shield piece 115. The protuberances 118 project in and have a substantially semispherical or bulging shape. A step is formed at an intermediate position of each shield piece 115, so that a leading end is offset out by as much as the step from the base end.

The shield pieces 115 are provided at the respective four sides of the shield shell 110. Specifically, two pieces are formed at each of an upper wall 111 and a lower wall 112 of the shell main body 110, and one piece is formed at each of a right wall 113 and a left wall 114 of the shell main body 110. In other words, six shield pieces 115 are formed in the entire shield shell 100.

The shield pieces 115 formed at the upper wall 111 face the shield pieces 115 formed at the lower wall 112 and are substantially vertically symmetrical. The shield piece 115 formed on the right wall 113 substantially faces the shield piece 115 formed on the left wall 114 and are substantially bilaterally symmetrical. The shield pieces 115 project into the receptacle 55 through communication holes 69 in the mounting flange 61 of the housing 40.

The resilient contact pieces 120 are U-turned at a rear edge of the shell main body 110 to extend forward while forming deformation spaces 128 between the shell main body 110 and themselves. Each resilient contact piece 120 is curved substantially arcuately, as shown in FIG. 17 and have top portions 123 hammered to form contacts 125.

The resilient contact pieces 120 are provided at three sides of the shell main body 110 except at the right wall 113. Specifically, two pieces 120A, 120B are formed on the upper wall 111 and two pieces 120C and 120D are formed on the lower wall 112. One piece 120E is formed on the left wall 114. Thus, five resilient contact pieces 120 are formed in the entire shield shell 100.

The shield shell 100 described above is to be mounted onto the terminal mounting portion 41 of the housing 40 from behind. Lock pieces 119 engage respective receiving portions (not shown) formed in the housing 40 to retain the shield shell 100 when the shield shell 100 is mounted to a front stop position shown in FIG. 18.

At this front stop position, the respective shield pieces 115 on the shell main body 110 project through the communication holes 69 in the mounting flange 61 and into the receptacle 55 to surround the tabs 32 of the male terminals 31. Further, the protection walls 70 at least partly surround the sides of the respective resilient contact pieces 120 on the shell main body 110.

As shown in FIG. 2, the opposite left and right sides of the resilient contact piece 120A are at least partly surrounded by the protection walls 75 and 71 and those of the resilient contact pieces 120B are at least partly surrounded by the protection walls 71 and 72. Further, as shown in FIG. 2, the opposite upper and lower sides of the resilient contact piece 120E are surrounded by the protection walls 74 and 75.

A specified clearance S is defined between each of the protection walls 71 to 75 and the outer peripheral surface of the terminal mounting portion 41. The clearances S define insertion spaces for the shell main body 110 to be mounted on the terminal mounting portion 41.

Next, a procedure of mounting the shield connector 30 on the mounting wall 20 of the housing case U is described. Here, it is assumed that the one or more male terminals 31 are already mounted into the shield connector 30.

To mount the shield connector 30 on the mounting wall 20, the shield connector 30 is positioned so that the terminal mounting portion 41 is oriented toward the mounting wall 20 and in front of the shaft hole 23. The terminal mounting portion 41 then is inserted and fit into the shaft hole 23 and the wires 35 connected to the male terminal 31 are passed through the shaft hole 23.

In this way, the resilient contact pieces 120 are inserted into the shaft hole 23 with their front ends in the lead. As this mounting operation proceeds, the top portions of the resilient contact pieces 120 enter the shaft hole 23 and contact the walls 24 of the shaft hole 23. The respective resilient contact pieces 120 are pushed in by the walls 24 of the shaft hole 23 as the mounting operation proceeds and resiliently deform with turned points at the front ends as supporting points.

Figure 19:
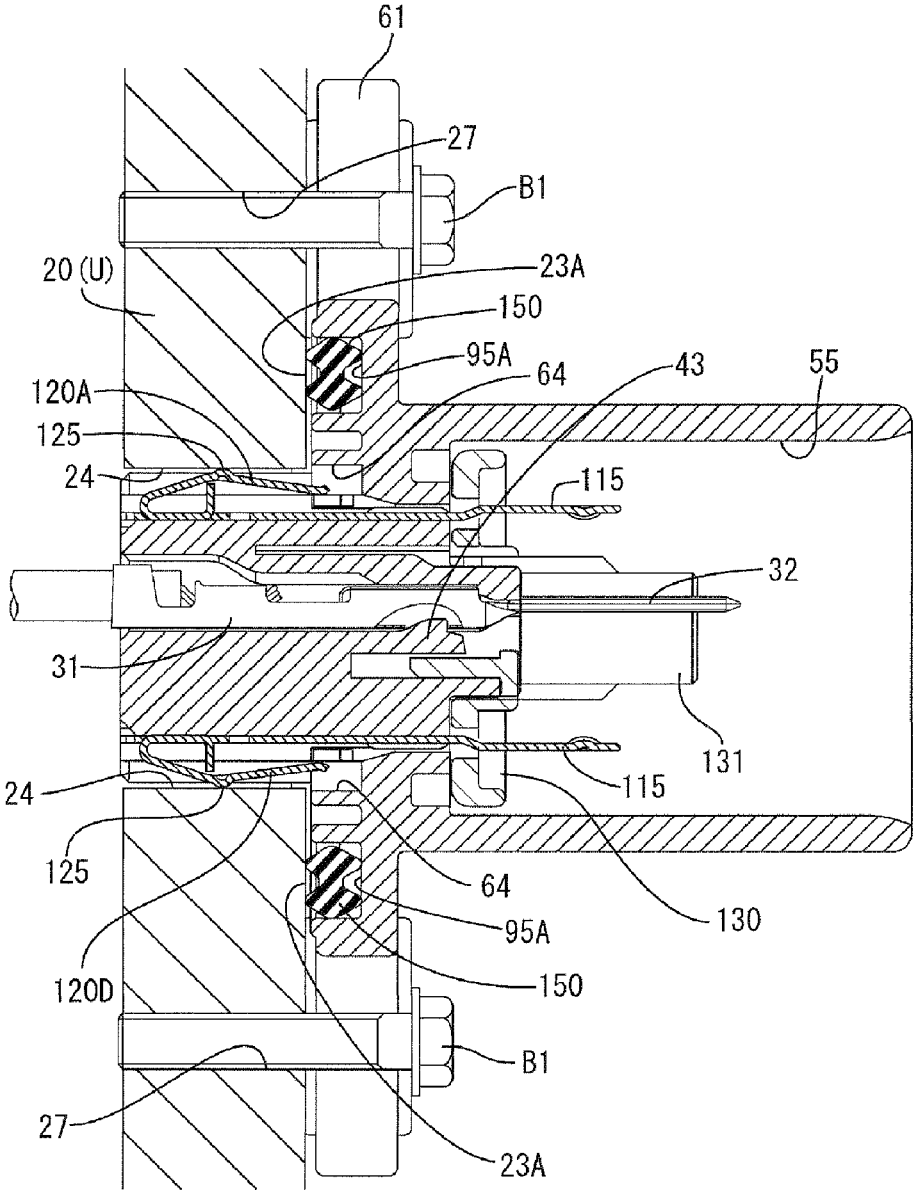
FIG. 19 is a section of the shield connector showing a mounting structure into a shaft hole.

The mounting flange 61 contacts an edge 23A of the shaft hole 23 when the terminal mounting portion 41 is inserted to a contact position shown in FIG. 19, thereby completing the mounting operation. At this time, the resilient contact pieces 120 formed on the three wall surfaces of the shell main body 110 are held resiliently in contact with the three walls 24 of the shaft hole 23.

Specifically, the respective contacts 125 of the resilient contact pieces 120A to 120D formed on the upper and lower walls 111, 112 of the shell main body 110 are held resiliently in contact with the upper and lower walls 24 of the shaft hole 23. Further, the contact pieces 85 of the auxiliary terminal mounting portion 81 contact the left wall 24 of the shaft hole 23 and the contact 125 of the resilient contact piece 120E formed on the left (left in FIG. 16) wall 114 of the shell main body 110 is held resiliently in contact with the right wall 24 of the shaft hole 23. In this way, the shell main body 110 is grounded to the mounting wall 20.

Mounting bolts B1 may be inserted through the bolt insertion holes 93 of the mounting flange 61 and screwed into the bolt holes 27 of the mounting wall 20 at four positions to tighten the mounting flange 61 equally against the hole edge 23A of the shaft hole 23 at four sides. Thus, the shield connector 30 is fixed to the mounting wall 20 to complete the mounting operation.

When the mounting operation is completed, the seal ring 150 of the shield connector 30 is squeezed between the hole edge 23A of the shaft hole 23 and the mounting groove 95, as shown in FIG. 19. Thus, the lips 153 of the seal ring 150 are resiliently held in contact with the hole edge 23A of the shaft hole 23 and a groove wall 95A of the mounting groove 95. In this way, connected parts of the shield connector 30 and the housing case U are sealed closely over substantially the entire periphery.

The fixing portions 160 and the locking holes 67 engaged with each other are arranged at the inner side of the ring main body 151. Thus, the shield connector 30 can be miniaturized more easily as compared with the case where they are arranged at the outer side. Further, a locking structure is completed inside the ring main body 151. Therefore, it is difficult for water to reach the sealing surface and a waterproof property can be improved. In addition, the locks 165 project toward the side (left side of FIG. 12) opposite to the sealing surface toward the mounting wall 20. Thus, the locks 165 will not affect the sealing property.

The locks 165 and the pressing walls 82, 83 that press the locks 165 are formed with the guiding slants 165A and the tapered surfaces 84. Thus, the engaging operation can be performed easily by guiding actions of both sides.

The shield connector 30 is pressed strongly and the seal ring 150 easily adheres to the wall surface of the mounting wall 20 at positions near the bolts B1. Thus, the seal ring 150 may adhere to the mounting wall 20 and detach from the shield connector 30 when the shield connector 30 is detached by loosening the bolts. However, the fixing portions 160 are provided at are formed at the four corners of the ring main body 151 and at the positions substantially corresponding to the bolts B1. Accordingly, the seal ring 150 is not likely to adhere to the mounting wall 20 and detach from the shield connector 30 when the shield connector 30 is detached by loosening the bolts.

Each bulge 161 has the substantially fan shape widened toward the corresponding corner of the ring main body 151 to increase the rigidity of each fixing portion 160. Therefore, it becomes possible to firmly lock the seal ring 150 in the connector 30 and it becomes more difficult to detach the seal ring 150.

The invention is not limited to the above described embodiment. For example, the following embodiment also is included in the scope of the invention.

The mounting flange 61 of the shield connector 30 is fixed to the mounting wall 20 by four bolts. The number of the bolts is not limited to four and, for example, two bolts may be used, i.e. the mounting flange 61 may be fixed at the opposite longitudinal sides. In this case, to cope with a change in the number of bolt tightening positions, it is preferable to provide the fixing portions 160 at the opposite sides of the ring main body 151.

What is claimed is:

1. A connector for use with a mounting member having a wall with a shaft hole, comprising:

a housing having opposite first and second ends, a terminal mounting portion at the first end and configured to fit into the shaft hole, a receptacle at the second end for receiving a mating connector, and a mounting flange between the first and second ends to be mounted on the wall surface of the mounting member, at least one locking hole formed in the housing in proximity to the mounting flange;

a terminal mounted in the terminal mounting portion and having a portion communicating with the receptacle; and a seal ring mounted to a surface of the mounting flange facing the mounting member for sealing between the mounting flange and the wall of the mounting member, the seal ring including a ring main body substantially surrounding the terminal mounting portion and at least one fixing portion for fixing the ring main body to the mounting flange, the fixing portion including at least one bulge formed at an inner peripheral side of the ring main body and at least one lock projecting from the bulge substantially toward a side opposite to a sealing surface toward the mounting member, the lock being engaged with the locking hole in the housing.

2. The connector of claim 1, wherein the mounting flange has at least one fastening seat with a bolt insertion hole for receiving a bolt to secure the connector to the mounting member, the fixing portion being at a position of the ring main body substantially corresponding to a position of the fastening seat.

3. The connector of claim 2, wherein the shaft hole formed in the wall of the mounting member is substantially rectangular, and the at least one fastening seat comprises four fastening seats respectively at four corners of the mounting flange corresponding to four corners of the substantially rectangular shaft hole.

4. The connector of claim 3, wherein the terminal mounting portion has a substantially rectangular outer shape at least partly fittable into the shaft hole, the ring main body has a substantially rectangular shape larger than the outer shape of the terminal mounting portion, and the at least one fixing portion comprises four fixing portions formed respectively at four corners of the ring main body.

5. The connector of claim 4, wherein each bulge has a fan shape widened toward the corresponding corner of the ring main body.

6. The connector of claim 1, further comprising at least one pressing wall formed in the housing and pressing a rear surface of the lock engaged with the locking hole.

7. The connector of claim 6, wherein the pressing wall has at least one tapered surface for guiding the lock into the locking hole.

8. The connector of claim 6, wherein at least one guiding slant is formed at a leading end of the lock.

9. The connector of claim 1, wherein annular lips are formed on at least one of front and rear sides of the ring main body.

10. The connector of claim 1, wherein the ring main body comprises at least one plate projecting in from the ring main body and dimensioned to fit closely into at least one flat portion formed in the housing.

11. The connector of claim 10, wherein housing has at least one hook and the plate has a hook hole engaged with the hook.

12. The connector of claim 1, wherein mounting flange has an annular mounting groove and the seal ring is mounted in the annular mounting groove.

13. The connector of claim 12, wherein the mounting flange has a base located at an inner side of the mounting groove, the base having at least one high wall and at least one low wall.

14. The connector of claim 1, further comprising a shield shell (100) being made of at least one conductive plate and including a shell main body and at least one resilient contact pieces mountable on the housing for shielding the connector.

15. The connector of claim 14, wherein the shield shell comprises at least one shield piece formed on the shell main body and projecting into the receptacle through at least one communication hole formed in the mounting flange and at least partly surrounding the portion of the terminal.

16. A connector, comprising:

a housing having opposite first and second ends, a terminal mounting portion at the first end and configured to fit into the shaft hole, a receptacle at the second end for receiving a mating connector, and a flange between the first and second ends, a mounting groove formed in a surface of the flange and surrounding the terminal mounting portion, and at least one pressing wall projecting out on the terminal mounting portion in proximity to the flange; and a seal ring (150) including a main body mounted in the mounting groove and at least one bulge formed at an inner peripheral side of the ring main body and being engaged between the mounting flange and the at least one pressing wall.

17. The connector of claim 16, wherein the housing further includes at least one locking hole substantially aligned with the at least one pressing wall and wherein the seal ring includes at least one lock projecting from the bulge and engaged with the locking hole in the housing.

18. The connector of claim 17, wherein the pressing wall has at least one tapered surface for guiding the lock into the locking hole.

19. The connector of claim 17, wherein at least one guiding slant is formed at a leading end of the lock.

20. The connector of claim 17, wherein housing has at least one flat portion and at least one hook in proximity to the flat portion, the seal ring has at least one plate projecting in from the ring main body and dimensioned to fit closely into the flat portion of the housing and the plate has a hook hole engaged with the hook.

* * * * *